US005859384A

United States Patent [19]

Hendrickson et al.

[11] Patent Number: 5,859,384

[45] Date of Patent: Jan. 12, 1999

[54] METHOD FOR PREPARING PROPELLANTS BY LATE ADDITION OF METALLIC FUEL

[75] Inventors: Roger R. Hendrickson; R. Scott Hamilton, both of Bear River City, Utah

[73] Assignee: Cordant Technologies Inc., Salt Lake City, Utah

[21] Appl. No.: 377,285

[22] Filed: Jun. 20, 1989

Related U.S. Application Data

[63] Continuation of Ser. No. 116,432, Nov. 3, 1987, abandoned.

[51] Int. Cl.[6] ..... C06B 45/10

[52] U.S. Cl. ..... 149/19.92; 149/19.4

[58] Field of Search ..... 149/19.92, 19.4

[56] References Cited

U.S. PATENT DOCUMENTS 3,892,610 7/1975 Huzinec ..... 149/19.92
3,932,240 1/1976 Braun et al. ..... 149/19.92 X
3,953,260 4/1976 Braun et al. ..... 149/19.92
4,070,212 1/1978 Mackay et al. ..... 149/19.93
4,427,468 1/1984 Duchesne et al. ..... 149/19.4 X
4,478,656 10/1984 Gibson ..... 149/19.4
4,493,741 1/1985 Ducote et al. ..... 149/19.4
4,708,754 11/1987 Sayles ..... 149/19.4

*Primary Examiner*—Peter A. Nelson
*Attorney, Agent, or Firm*—Pillsbury Madison & Sutro LLP; Ronald L. Lyons

[57] ABSTRACT

There is provided an improved process for preparing a composite propellant comprising (a) a polymeric binder, (b) a bonding agent, (c) a curing agent for the binder, (d) a metallic fuel, and (e) an ammonium salt oxidizer wherein the improvement resides in adding the metallic fuel to the propellant mix after all of the ammonium salt oxidizer has been added to the propellant mix.

18 Claims, 3 Drawing Sheets

METHOD FOR PREPARING PROPELLANTS BY LATE ADDITION OF METALLIC FUEL

This is a continuation of application Ser. No. 07/116,432 filed on Nov. 3, 1987, and now abandoned.

The U.S. Government has a nonexclusive, nontransferable, royalty-free license to make, use, or sell the invention pursuant to Contract No. FO4611-82-C-0011 awarded by the Air Force to Morton Thiokol, Inc.

BACKGROUND OF THE INVENTION

Composite propellants typically comprise (a) a polymeric binder, (b) a bonding agent, (c) a curing agent for the binder, (d) a metallic fuel and (e) an ammonium salt oxidizer. Traditionally, these composite propellants have been prepared by the following procedure:

1. premixing the polymeric binder and bonding agent;
2. admixing the metallic fuel with the premix;
3. admixing a portion of the oxidizer with the mixture produced by step 2;
4. vacuum mixing the mixture produced in step 3;
5. adding a second portion of the oxidizer and vacuum mixing the resulting product;
6. adding a third (and final) portion of the oxidizer and continuing vacuum mixing;
7. optionally, aging the mixture produced in step 6 for about 24 hours; and
8. adding the curing agent and vacuum mixing.

It has now been discovered that if the order of addition of the ingredients in a composite propellant is altered, the viscosity of the propellant during mixing is substantially reduced, removal of ammonia from the propellant is faster and dramatic cost savings (in terms of man-hours and energy required to prepare the propellant) are achieved without sacrificing mechanical or ballistic properties of the finished propellant.

SUMMARY OF THE INVENTION

In accordance with the present invention there is provided an improved process for preparing a composite propellant comprising (a) a polymeric binder, (b) a bonding agent, (c) a curing agent for the binder, (d) a metallic fuel and (e) an ammonium salt oxidizer wherein the improvement comprises adding the metallic fuel to the propellant mix after all of the ammonium salt oxidizer has been added to the propellant mix.

In accordance with the present invention, there is provided an improved process for preparing a composite propellant comprising (a) a polymeric binder, (b) a bonding agent, (c) a curing agent for the binder, (d) a metallic fuel and (e) an ammonium salt oxidizer wherein the improvement comprises:

1. mixing a polymeric binder and bonding agent;
2. admixing a portion of the ammonium salt oxidizer with the mixture produced by step 1 and vacuum mixing until substantially all of the ammonia has evolved from the mixture;
3. admixing the remainder of the ammonium salt oxidizer with the mixture produced by step 2;
4. admixing the metallic fuel with the mixture produced in step 3;
5. optionally, aging the mixture produced in step 4 for about 24 hours; and
6. admixing the curing agent with the resulting mixture.

DETAILED DESCRIPTION OF THE PREFERRED EMBODIMENTS

Figure 1:
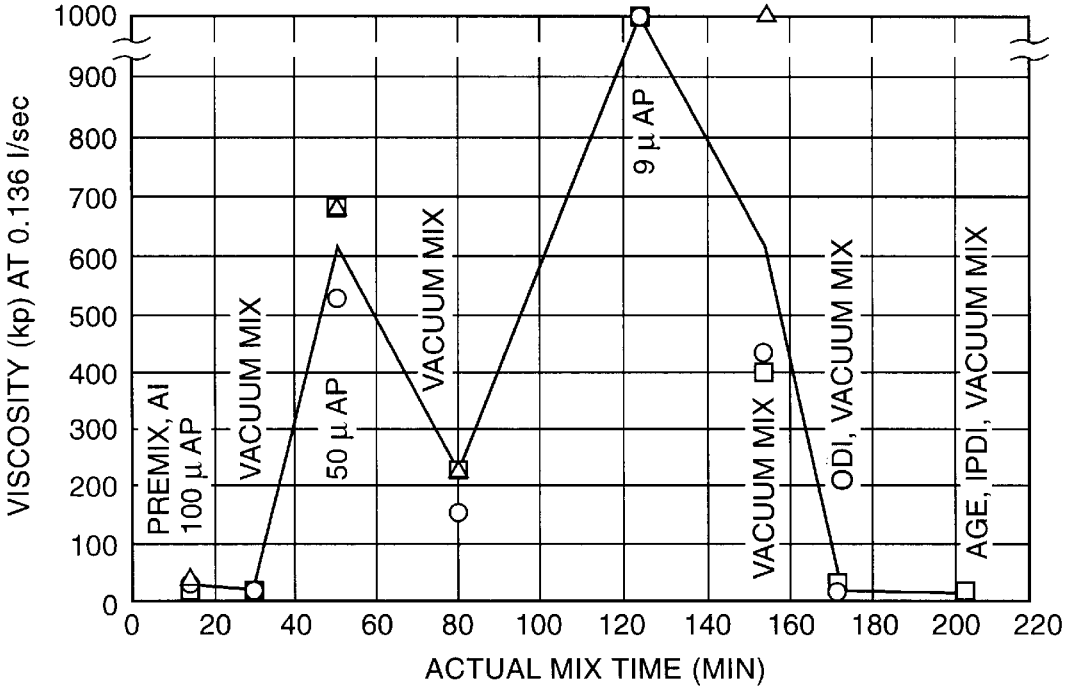
FIG. 1 graphically illustrates viscosity vs time for the preparation of three composite propellants according to the traditional method.

The composite propellants useful in the practice of this invention typically contain (a) a polymeric binder, (b) a bonding agent, (c) a curing agent for the binder, (d) a metallic fuel and (e) an ammonium salt oxidizer. The polymeric binder most commonly employed in composite propellants is a liquid, hydroxy terminated polybutadiene prepolymer, such as that sold by Sartomer Company under the designation R45M. However, other polymeric binders, which are known in the art, such as, for example, carboxy or epoxy terminated polybutadienes, may be employed in place of the hydroxy terminated polybutadiene.

The bonding agents useful in the propellants made in accordance with the present invention are capable of reacting with the ammonium salt oxidizer and evolving ammonia during processing and of being absorbed onto the metallic fuel. Two examples of such bonding agents are sold under the designation TEPANOL and TEPAN. TEPANOL is the addition product of tetraethylenepentaamine, acrylonitrile and glycidol; and TEPAN is the addition product of tetraethylenepentaamine and acrylonitrile.

The selection of curing agent for the polymeric binder will, of course, depend upon the particular polymeric binder employed. In the case of hydroxy terminated polybutadiene binders the curing agents usually employed are di- or polyisocyanates. Examples of such curing agents may be found in U.S. Pat. No. 4,184,031, issued Jan. 15, 1980 to Graham et al. which is hereby incorporated by reference. A commonly employed example of these isocyanates is isophorone diisocyanate (IPDI).

The metallic fuel and ammonium salt oxidizer most commonly used in composite propellants are powdered aluminium and ammonium perchlorate, respectively, although other metallic fuels and ammonium salt oxidizers known in the art may likewise be employed.

The composite propellant formulations useful in the practice of this invention may, of course, contain other ingredients in addition to those discussed above. Thus, plasticizers, fillers, reinforcing agents, burn rate modifiers and the like may be used. One additive which has been found to be particularly useful in the practice of this invention is an alkyl monoisocyanate, such as the $C_{10}$–$C_{25}$ alkyl monoisocyanates, an example of which is octadecyl isocyanate (ODI). It has been found that the addition of ODI to the propellant reduces the viscosity of the propellant and thereby aids processing. The amount of ODI employed will vary depending upon the viscosity of the propellant mix and, in fact, may not be necessary at all if the viscosity of the mix is already sufficiently low. In general, however, the alkyl monoisocyanate is employed in an amount sufficient to reduce the viscosity of the propellant mix but not so much as to affect the strain properties of the final, cured propellant. Normally, this amount will be about 0.01% to 0.10% based on total propellant weight.

The amounts of the ingredients of the composite propellants useful in this invention may, of course, vary depending upon many factors such as desired physical properties of the cured propellant, burn rate characteristics and the like. However, a typical example of a composite propellant useful in the practice of the present invention is as follows:

| Ingredient | Weight Percent Based on Total Propellant Weight |
|---|---|
| Hydroxy terminated polybutadiene | |
| TEPANOL | |
| ODI | 12% |
| IPDI | |
| Triphenyl bismuth (catalyst) | |
| Aluminum | 19% |
| Ammonium perchlorate | 69% |

The process of the present invention basically involves adding the metallic fuel after all of the ammonium salt oxidizer has been added to the propellant mix, which is in contrast to the traditional method of mixing composite propellants which has been to add the metallic fuel prior to the addition of the oxidizer. While not wishing to be bound by any theory, it is believed that the bonding agent adsorbs onto the metallic (aluminum) powder surface and must desorb reacting with the ammonium salt oxidizer. Therefore, by adding the metallic (aluminum) fuel last, the rate limiting-desorption step is eliminated and the reaction between the bonding agent and the ammonium salt oxidizer proceeds to completion faster. This also allows the ammonia reactive alkyl monoisocyanate, when employed, to be added sooner, which results in lower viscosity throughout the mix cycle. It has been quite unexpectedly found that this alteration in the order of addition of the metallic fuel and oxidizer provides several significant advantages over the traditional manner of making composite propellants. For example, by practicing the process of the present invention, the viscosity of the propellant during mixing is substantially reduced, and the removal of the ammonia evolved during mixing is faster. This results in dramatic savings in terms of man-hours and cost. For example, energy costs may be decreased by as much as 80% when the process of the present invention is employed instead of the traditional method.

The present invention is further illustrated by the following examples which are not intended to limit the invention or its scope in any manner. Also, the mix times indicated in the following examples are determined by mixing each propellant mix until its viscosity is within a desired range (sometimes called a viscosity "gate").

EXAMPLE 1

The following formulation was used to prepare a composite propellant:

| Ingredient | Weight Percent Based on Total Propellant Weight |
|---|---|
| Hydroxy terminated polybutadiene (R45M) | |
| TEPANOL | |
| ODI | 12% |
| IPDI | |
| Triphenyl bismuth (catalyst) | |
| Aluminum | 19% |
| Ammonium perchlorate (AP) | 69% |

Two procedures were used to prepare the propellants, one, the traditional method, in which the the aluminum was added to the propellant mix prior to the addition of the AP, and the other, a method in accordance with the present invention, wherein the aluminum was added after all of the AP had been added to the propellant.

The following illustrates the preparation of three propellants according to the traditional mixing method:

| | Mix Time (Minutes) | | |
|---|---|---|---|
| Mix Step | Prop. 1 | Prop. 2 | Prop. 3 |
| Premix binder, Tepano1 and Al | — | — | — |
| Warm up | 45 | 45 | 45 |
| Add 100 u AP | 41 | 57 | 52 |
| Mix at ambient conditions ("amb.") | 10 | 10 | 10 |
| Vacuum mix | 38 | 42 | 38 |
| Add 50 uAP | 36 | 39 | 40 |
| Ambient mix | 20 | 20 | 20 |
| Vacuum mix | 87 | 86 | 82 |
| Ambient mix | 1 | 0 | 1 |
| Add 9 u AP | 45 | 60 | 61 |
| Ambient mix | 5 | 26 | 7 |
| Ambient and vacuum mix | 193 | 174 | 117 |
| Add ODI, vacuum mix | 84 | 84 | 82 |
| Prebatch age | 137 hr. | 147 hr. | 158 hr. |
| Add curing agent | 10 | 10 | 10 |
| Vacuum mix | 35 | 39 | 40 |
| TOTAL MIX TIME | 650 | 692 | 605 |

The following illustrates the preparation of a propellant according to the present invention:

| Mix Step | Mix Time (Minutes) |
|---|---|
| Premix binder, Tepanol | — |
| Add 100 u and 50% of 50 u AP | 25 |
| Vacuum mix | 90 |
| Add ODI, 50% of 50 u AP and all of 9 u AP | 25 |
| Vacuum mix | 45 |
| Add Al | 20 |
| Vacuum mix | 102 |
| Prebatch age | 16 hr. |
| Add curing agent | 25 |
| TOTAL MIX TIME | 332 |

EXAMPLE 2

Viscosity versus actual time was determined for three propellants mixed in accordance with the traditional methods and three propellants mixed by the method of this invention, in a manner similar to that of Example 1.

Figure 2:
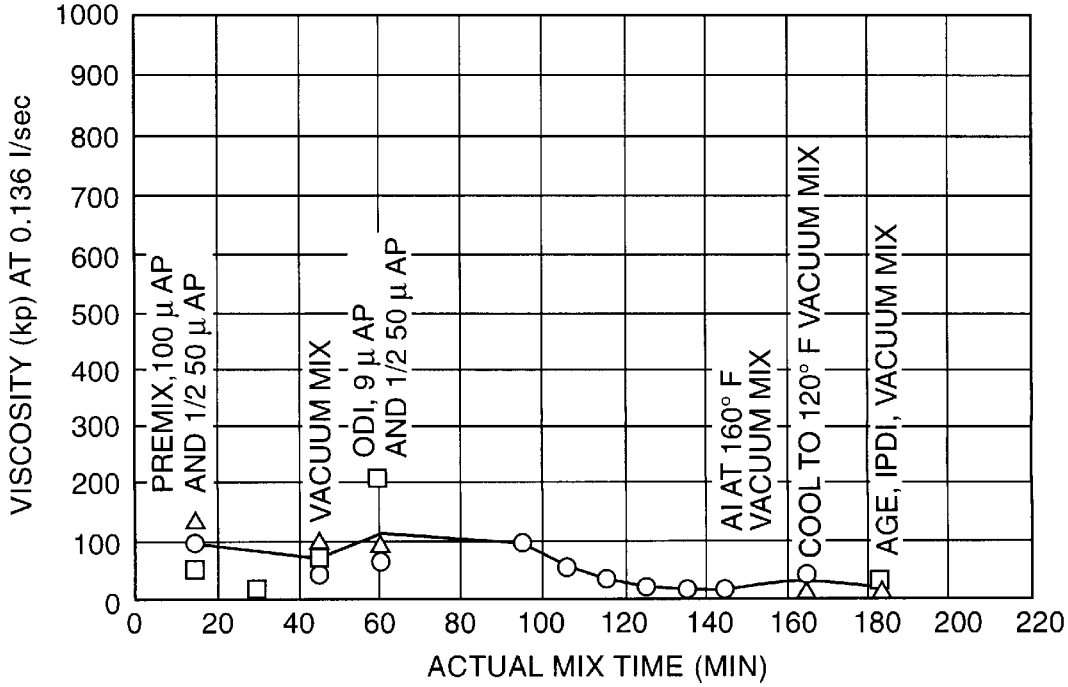
FIG. 2 graphically illustrates viscosity vs time for the preparation of three composite propellants in accordance with the method of the present invention.

FIG. 1 illustrates viscosity vs. time for the traditional method and indicates the various process steps. Likewise, FIG. 2 illustrates viscosity vs. time and process steps for the method of the present invention. It is clearly evident that the viscosity of the propellant mix is drastically reduced when the propellant is prepared in accordance with this invention.

EXAMPLE 3

Figure 3:
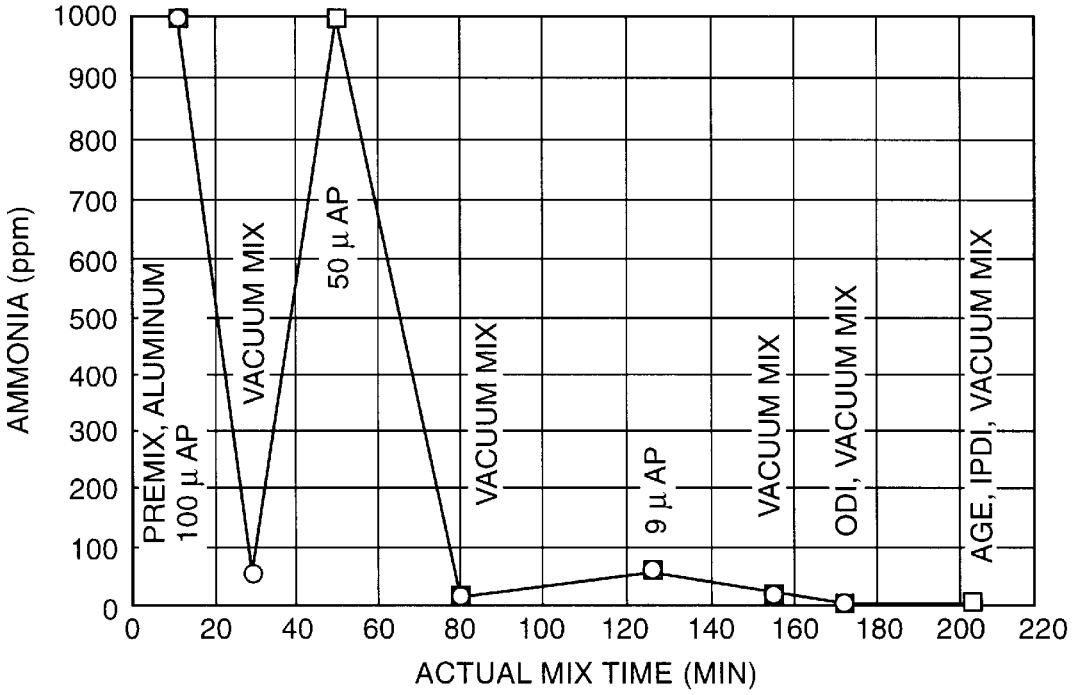
FIG. 3 graphically illustrates the amount of ammonia in the atmosphere above the propellant mix (as measured by Drager tube) vs time for three propellants prepared by the traditional method.
Figure 4:
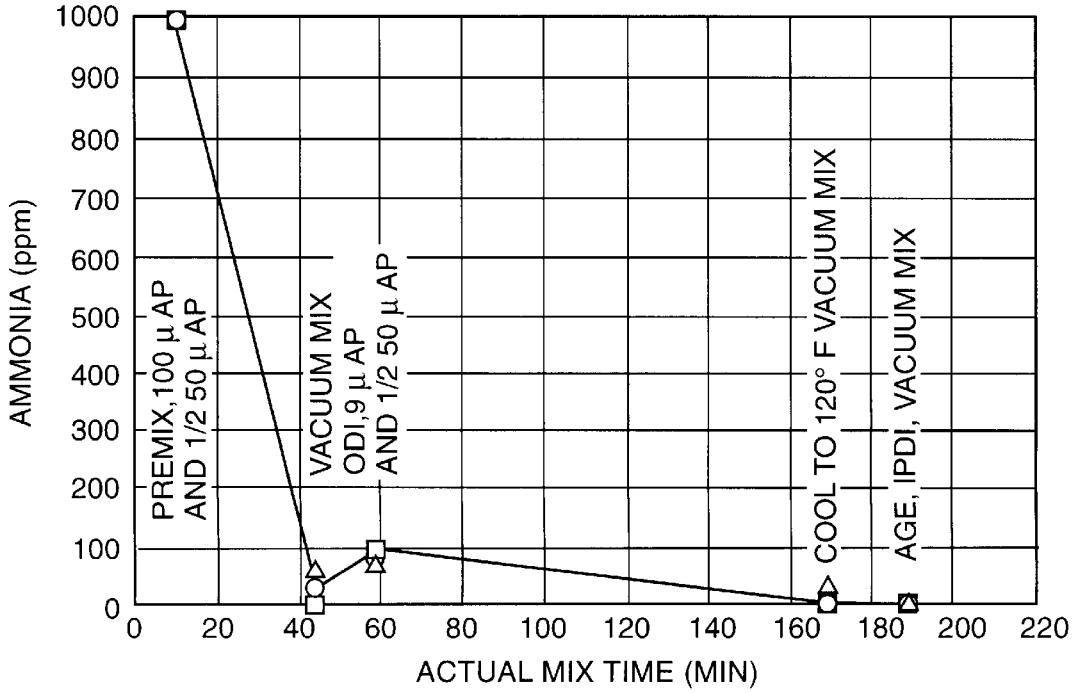
FIG. 4 graphically illustrates the amount of ammonia in the atmosphere above the propellant mix vs time for three propellants prepared in accordance with the present invention.
Figure 5A:
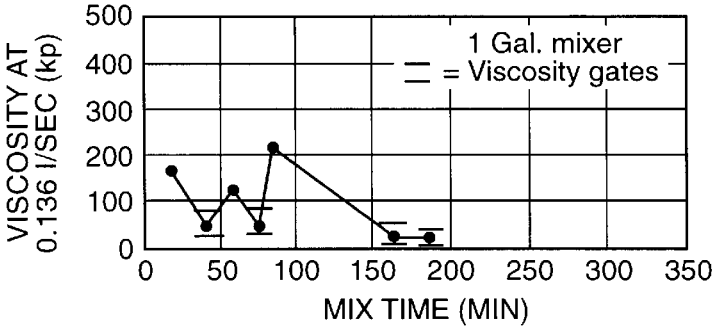
FIG. 5 graphically illustrates the viscosity of propellant mixes made in accordance with the present invention for 1, 5, 50 and 600 gallon batches.
Figure 5B:
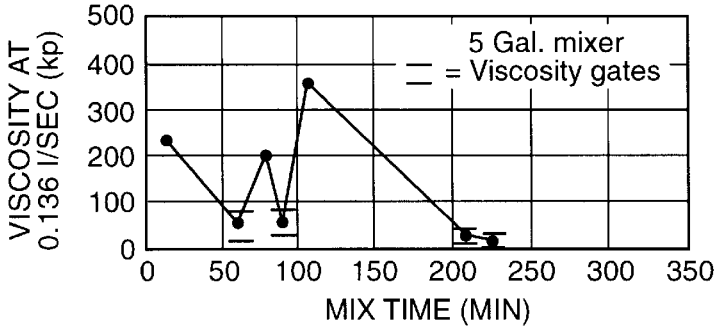
Figure 5C:
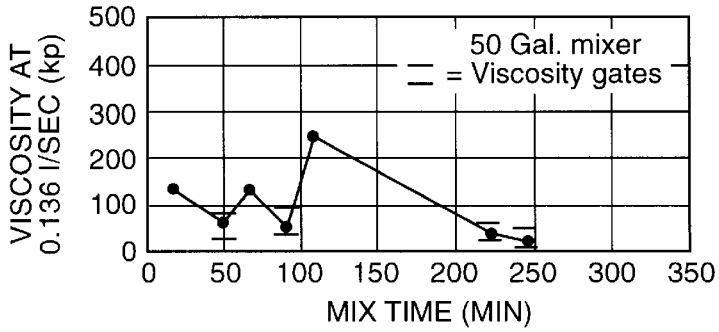
Figure 5D:
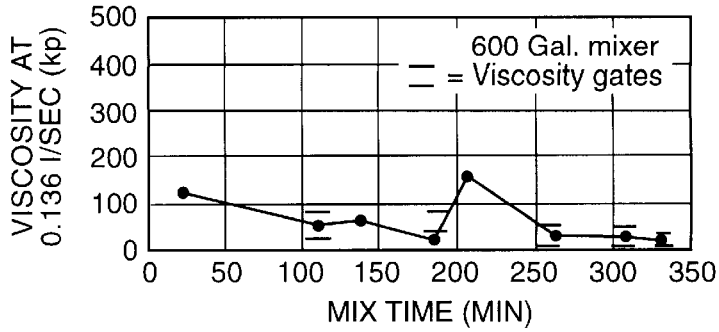

Ammonia evolution vs. time was also measured for the propellant mixes of Example 2. FIG. 3 illustrates the amount of ammonia in the atmosphere above the mix vs. time for the three traditionally prepared propellants and FIG. 4 is ammonia in the atmosphere vs. time for the three propellants prepared by the method of this invention the evolution of ammonia is much faster with the method of the present invention.

EXAMPLE 4

Using the same propellant formulation as in example 1, the process of the present invention was scaled-up from 1 gallon mixes, to 5, 50 and 600 gallon mixes using the process of the present invention. FIG. 5 graphically illustrates the viscosity of the propellant mixes at various times.

We claim:

1. In a process for preparing a composite propellant comprising (a) a polymeric binder, (b) a bonding agent, (c) a curing agent for the binder, (d) a metallic fuel and (e) an ammonium salt oxidizer, the improvement comprising:

1. mixing the polymeric binder and bonding agent;
2. admixing a portion of the ammonium salt oxidizer with the mixture produced in step 1 and mixing until substantially all of the ammonia has evolved from the mixture;
3. admixing the remainder of the ammonium salt oxidizer with the mixture produced in step 2; and
4. admixing the metallic fuel with the mixture produced in step 3.

2. In a process for preparing a composite propellant from constituents comprising (a) polymeric binder, (b) a bonding agent, (c) a curing agent for the binder, (d) a metallic fuel, and (e) an ammonia salt oxidizer, the improvement comprising:

(i) mixing the polymeric binder and bonding agent;

(ii) admixing a portion of the ammonia salt oxidizer with the mixture produced in step (i) and mixing until substantially all of the ammonia has evolved from the mixture;

(iii) add mixing the remainder of the ammonia salt oxidizer with the mixture produced in step (ii);

(iv) mixing the metallic fuel with the mixture produced in step (iii); and (v) aging the mixture produced in step (iv).

3. The process according to claim 2, wherein step (v) is conducted for about twenty four hours.

4. The process according to claim 2, wherein said process further comprises:

add mixing a curing agent with the mixture produced in step (iv).

5. The process of claim 2 further comprising admixing the curing agent with the mixture produced in step (v).

6. The process of claim 1 further comprising adding an alkyl monoisocyanate to the propellant mix in step 3.

7. The process of claim 6 wherein the alkyl monoisocyante is octadecyl isocyanate.

8. In a process for preparing a composite propellant from constituents comprising (a) a polymeric binder, (b) a bonding agent, (c) a curing agent for the binder, (d) a metallic fuel and (e) an ammonia salt oxidizer, the improvement comprising:

(i) mixing the polymeric binder and bonding agent;

(ii) admixing a portion of the ammonia salt oxidizer with the mixture produced in step (i) and mixing until substantially all of the ammonia has evolved from the mixture;

(iii) admixing the remainder of the ammonia salt oxidizer with the mixture produced in step (ii);

(iv) add mixing the metallic fuel with the mixture produced in step (iii); and (v) add mixing the curing agent with the mixture produced in step (iv).

9. The process according to claim 8, wherein said process further comprises adding an alkyl monoisocyanate to the propellant mix in step (iii).

10. The process according to claim 9, wherein the alkyl monoisocyanate is octadecyl isocyanate.

11. The process according to claim 2, wherein the bonding agent is the addition product of tetraethylenepentaamine and acrylonitrile.

12. The process according to claim 2, wherein the metallic fuel is powdered aluminium.

13. The process according to claim 9, wherein said alkyl monoisocyanate is a $C_{10}$–$C_{25}$ alkyl monoisocyanate.

14. The process according to claim 2, wherein the polymeric binder comprises hydroxy terminated polybutadiene.

15. The process according to claim 2, wherein said metallic fuel is powdered aluminum and the bonding agent is the addiiton product of tetraethylenepentaamine and acrylonitrile.

16. The process according to claim 15, wherein said process further comprises adding an alkyl isocyanate to the propellant mix in step (iii).

17. In process for preparing a composite propellant from ingredients comprising (a) a polymeric binder, (b) a bonding agent, (c) a curing agent for the binder, (d) a metallic fuel and (e) an ammonia salt oxidizer, the improvement comprising adding the metallic fuel to the propellant mix after all of the ammonium salt oxidizer has been added to the propellant mix, said propellant mix containing said bonding agent.

18. The process according to claim 11, wherein the bonding agent comprises the addition product of tetraethylenepentaamine, acrylonitrile and glycidol.

* * * * *